US010900215B1

(12) United States Patent
Alrubaidi et al.

(10) Patent No.: US 10,900,215 B1
(45) Date of Patent: Jan. 26, 2021

(54) REINFORCED JOINT FOR BEAM-COLUMN CONNECTION

(71) Applicant: KING SAUD UNIVERSITY, Riyadh (SA)

(72) Inventors: Mohammad Alrubaidi, Riyadh (SA); Husain Abbas, Riyadh (SA); Hussein M. Elsanadedy, Riyadh (SA); Tarek H. Almusallam, Riyadh (SA); Yousef A. Al-Salloum, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 16/828,888

(22) Filed: Mar. 24, 2020

(51) Int. Cl.
*E04B 1/24* (2006.01)

(52) U.S. Cl.
CPC .... *E04B 1/2403* (2013.01); *E04B 2001/2415* (2013.01); *E04B 2001/2445* (2013.01); *E04B 2001/2448* (2013.01)

(58) Field of Classification Search
CPC ..... E04B 1/2403; E04B 2001/2415; E04B 2001/2445; E04B 2001/2448
See application file for complete search history.

(56) References Cited

U.S. PATENT DOCUMENTS 2,720,291 A * 10/1955 Larkin ..... E04B 1/2403 403/169
5,660,017 A * 8/1997 Houghton ..... E04B 1/2403 52/167.3
6,138,427 A * 10/2000 Houghton ..... E04B 1/2403 52/236.3
9,091,065 B2 * 7/2015 Tran ..... E04B 1/40
10,415,230 B1 9/2019 Abbas et al.
2002/0124520 A1 * 9/2002 Bock ..... E04B 1/2403 52/655.1
2005/0204684 A1 * 9/2005 Houghton ..... E04B 1/24 52/653.1

(Continued)

FOREIGN PATENT DOCUMENTS

CN 105863056 A 8/2016
JP 11170044 A 6/1999

OTHER PUBLICATIONS

Crawford, John E. "Retrofit methods to mitigate progressive collapse." The Multihazard Mitigation Council of the National Institute of Building Sciences, Report on the Jul. 2002 National Workshop and Recommendations for Future Effort. 2002.

*Primary Examiner* — Ryan D Kwiecinski
(74) *Attorney, Agent, or Firm* — Nath, Goldberg & Meyer; Richard C. Litman

(57) ABSTRACT

The reinforced joint for a beam-column connection is provided for improving the resistance of steel-framed buildings against progressive collapse. Flange stiffening plates reinforce flanges of structural beams, with beam web stiffeners being attached to and extending between the flange stiffening plates. Additional column web stiffeners are attached to and extend between flanges of a structural column. A longitudinal cover stiffening plate is attached to the column stiffeners and the flange stiffening plates, extending across the joint and at least partially covering the beam web stiffeners. The reinforced joint between the structural beams and the structural column develops catenary action in the structural beams in the event of collapse.

5 Claims, 11 Drawing Sheets

(56) References Cited

U.S. PATENT DOCUMENTS

| | | | | |
|---|---|---|---|---|
| 2006/0144006 | A1* | 7/2006 | Suzuki | E04H 9/024 52/655.1 |
| 2011/0030305 | A1* | 2/2011 | Karns | E04B 1/2403 52/650.1 |
| 2014/0083046 | A1* | 3/2014 | Yang | E04B 1/24 52/704 |
| 2014/0182234 | A1* | 7/2014 | Yang | E04B 1/2403 52/655.1 |
| 2015/0275501 | A1* | 10/2015 | Houghton | E04H 9/024 52/854 |
| 2018/0266099 | A1* | 9/2018 | Lippert | E04B 1/1903 |
| 2018/0347222 | A1* | 12/2018 | Richards | E04H 9/021 |

* cited by examiner

REINFORCED JOINT FOR BEAM-COLUMN CONNECTION

BACKGROUND

1. Field

The disclosure of the present patent application relates to structural joints, and particularly to a reinforced joint for beam-column connection in a steel frame building that uses steel plates welded in the area about the beam-column connection to develop catenary action in the beams in the event of column failure.

2. Description of the Related Art

Building frames, such as typical steel building frames, are often exposed to extreme load events, such as those caused by large wind forces, earthquakes, vehicle crashes and blast loads. The ability of steel to yield under external forces is one of the reasons that steel is seen as an ideal building material for structural frames. However, steel buildings are still susceptible to progressive collapse under extreme conditions due to exposure to blast loads. The performance of steel-framed buildings primarily depends on the behavior of the frame's beam-column joints. The properties of the joints are crucial in a steel-framed building, since they determine the constructability, stability, strength, flexibility, residual forces, and ductility of the overall structure.

Progressive collapse is the propagation of an initial local failure from one part of the building to the adjoining parts, resulting in the eventual collapse of the entire building, or at least large parts thereof. In order to resist progressive collapse of buildings, the "alternate path" method is typically employed in the design. In this method, alternate paths are available for load transfer if one critical component, such as a column, fails, thus preventing progressive collapse. If a column of a building frame fails (due to a blast or seismic forces, for example), steel-framed buildings should have well-defined redundancies so that alternative load paths are available via the formation of catenary action. Unfortunately, effective alternative load paths via catenary action are frequently lacking in present building designs.

Thus, a reinforced joint for beam-column connection solving the aforementioned problems is desired.

SUMMARY

The reinforced joint for a beam-column connection is provided for improving the resistance of steel-framed buildings against progressive collapse, such as may be caused by damage to one or more columns as a result of exposure to blast loads or other extreme loads. In one embodiment, in which the reinforced joint for a beam-column connection is used as an internal joint in the building frame, first upper and lower flange stiffening plates are respectively attached to inner faces of the upper and lower flanges of a first structural beam (as well as being connected to a column flange). Similarly, second upper and lower flange stiffening plates are respectively attached to inner faces of upper and lower flanges of a second structural beam (as well as being connected to an opposed column flange), where the first and second structural beams extend in opposite directions from a column at the center of a connection joint between the first and second structural beams and the column.

At least one first beam web stiffener is attached to and extends between the first upper and lower flange stiffening plates, and at least one second beam web stiffener is attached to and extends between the second upper and lower flange stiffening plates. Upper and lower column web stiffeners are also attached to and extend between first and second flanges of the structural column. The upper and lower column web stiffeners are respectively aligned with the first and second upper flange stiffening plates and with the first and second lower flange stiffening plates. A cover stiffening plate is attached to the upper and lower column web stiffeners, the first and second upper flange stiffening plates, and the first and second lower flange stiffening plates. The cover stiffening plate extends between the at least one first beam web stiffener and the at least one second beam web stiffener.

In an alternative embodiment, in which the reinforced joint for a beam-column connection is used as an external joint in the building frame, upper and lower flange stiffening plates are respectively attached to inner faces of upper and lower flanges of a structural beam. The upper and lower flange stiffening plates are positioned adjacent a connection joint between the structural beam and a structural column. At least one beam web stiffener is attached to, and extends between, the upper and lower flange stiffening plates.

Additionally, upper and lower column web stiffeners are attached to and extend between first and second flanges of the structural column. The upper and lower column web stiffeners are aligned with the upper and lower flange stiffening plates, respectively. A cover stiffening plate is attached to the upper and lower column web stiffeners and the upper and lower flange stiffening plates. The cover stiffening plate extends between the at least one beam web stiffener and the second flange of the structural column. The stiffeners and stiffening plates are preferably attached to the corresponding flanges and web by welding.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
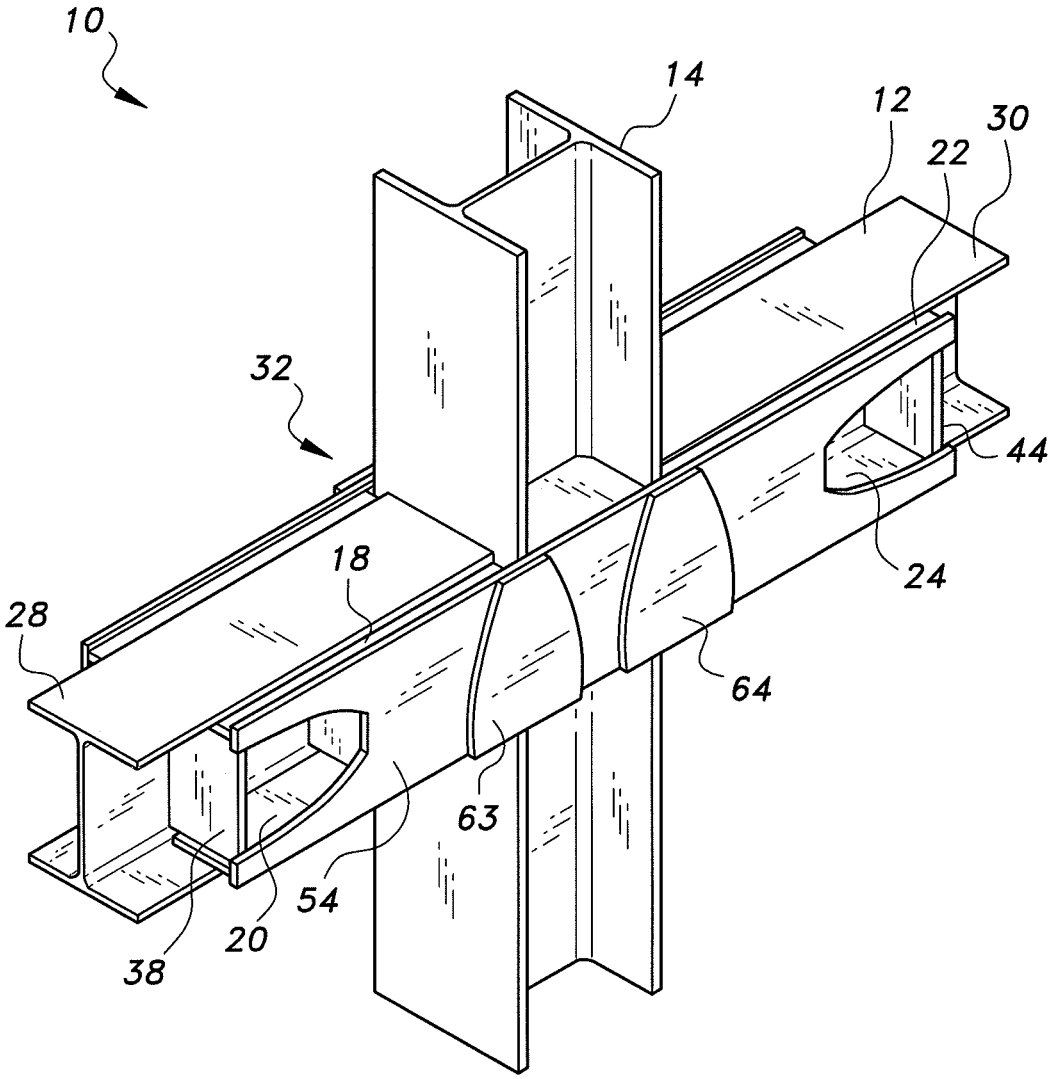
FIG. 1 is a partial perspective view of a reinforced joint for beam-column connection for an interior beam-column joint in a steel frame building.
Figure 2:
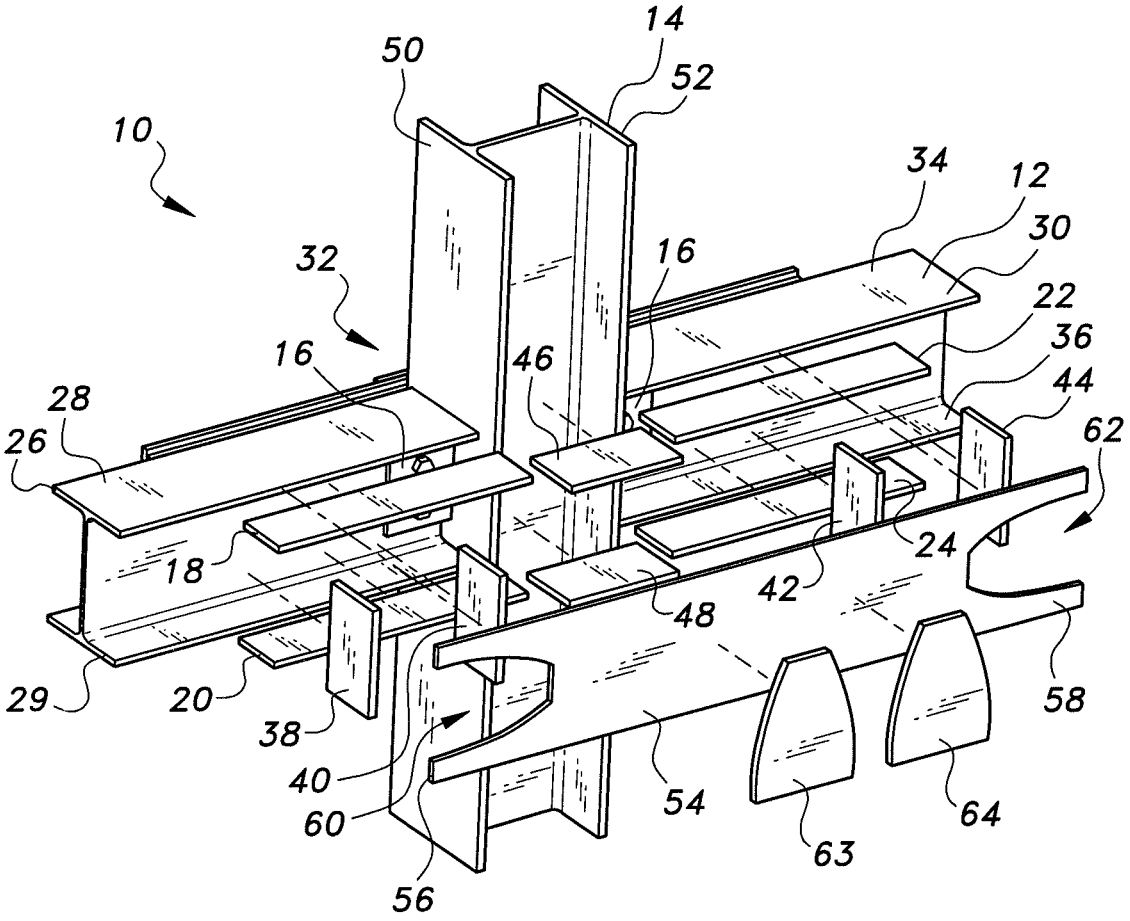
FIG. 2 is a partially exploded perspective view of the reinforced joint of FIG. 1.
Figure 3:
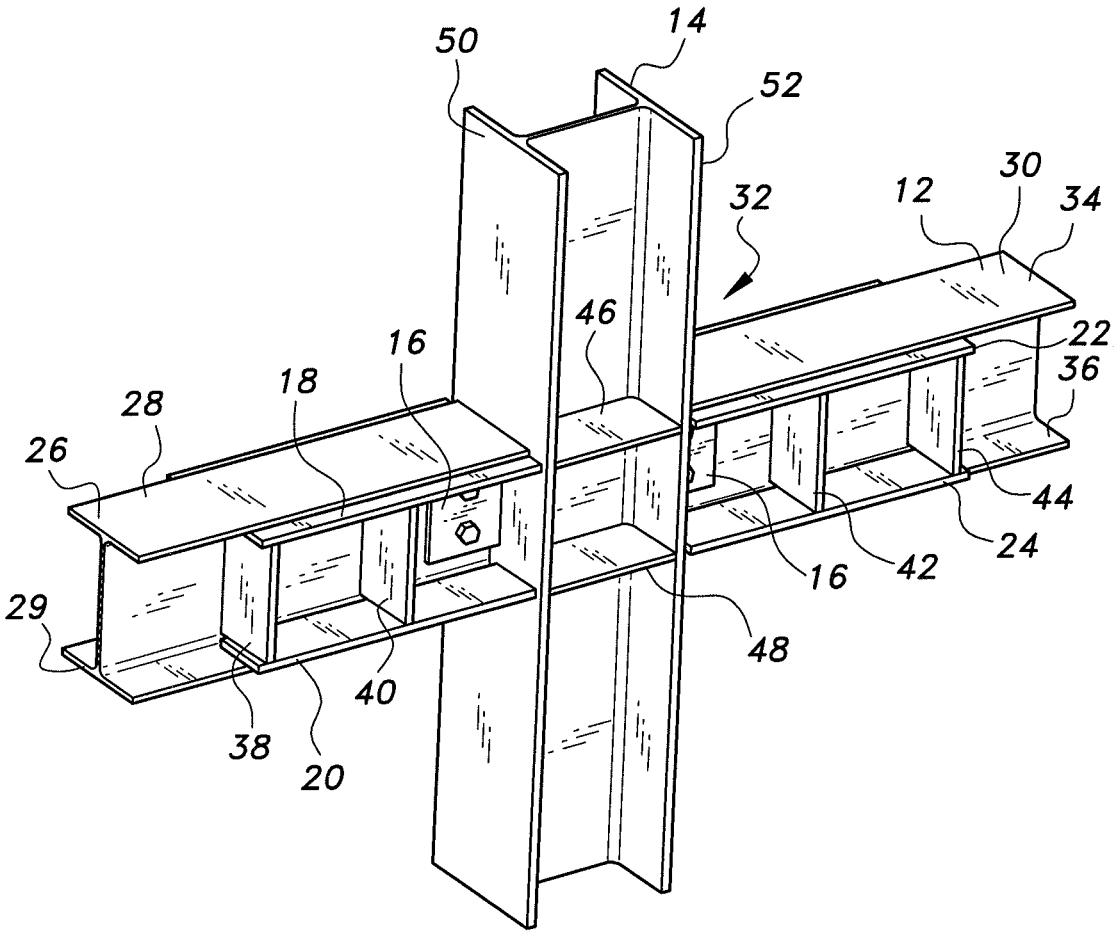
FIG. 3 is a partial perspective view of the reinforced joint of FIG. 1, shown without the longitudinal cover plate.

Referring to FIGS. 1-3, a reinforced joint for beam-column connection 10 is provided for improving the resistance of steel-framed buildings against progressive collapse, such as may be caused by damage to one or more columns as the result of exposure to blast loads or other extreme loads. In FIGS. 1-3, the reinforced joint for a beam-column connection 10 is used as an internal joint in the building frame. As shown, first upper and lower flange stiffening plates 18, 20 are attached to inner faces of upper and lower flanges 26, 29, respectively, of a first structural beam 28 of a set 12 of structural beams. The first upper and lower flange stiffening plates 18, 20 may be welded to the inner faces of the upper and lower flanges 26, 29 of the first structural beam 28. The set 12 of structural beams also includes a second structural beam 30. Second upper and lower flange stiffening plates 22, 24 are attached to inner faces of upper and lower flanges 34, 36, respectively, of the second structural beam 30. The second upper and lower flange stiffening plates 22, 24 may be welded to the inner faces of the upper and lower flanges 34, 36 of the second beam 30. As shown, the first and second structural beams 28, 30, respectively, of the set 12 of structural beams extend in opposite directions from a column 14 at the center of a connection joint 32 between the first and second structural beams 28, 30 and the column 14. It will be understood that the column 14 and the beams 28, 30 are not drawn to scale in the drawings, but each have a much greater length, the stiffening plates 18, 20, 22, 24 only being attached to the column 14 and beams 28, 30 in the region immediately adjacent the beam-column joint 32.

Each of the flange stiffening plates 18, 20, 22, 24 may have a length of k $D_b$+g, a width of $(B_{f,c}-_{wr,b})/2$ and a thickness greater than or equal to $t_{f,b}$, where k=2 to 2.5, $D_b$ is the depth of each of the structural beams of set 12, g is the gap between the end of each of the structural beams of set 12 and the face of the structural column 14, $B_{f,c}$ is the width of the flanges of the structural column 14, $t_{w,b}$ is the thickness of the web of each of the structural beams of set 12, and $t_{f,b}$ is the thickness of each flange of each of the structural beams of set 12. Each of the flange stiffening plates 18, 20, 22, 24 may have chamfered or filleted corners. Further, each of the flange stiffening plates 18, 20, 22, 24 may be formed from steel or the like. Additionally, it should be understood that the connection between the first and second structural beams 28, 30 and structural column 14 shown in FIGS. 1-3 is shown for exemplary purposes only, and that the reinforced joint 10 may be applied to any suitable type of beam-joint connection, such as, but not limited to, simple (i.e., pinned) connections, semi-rigid connections, and moment connections.

Figure 7:
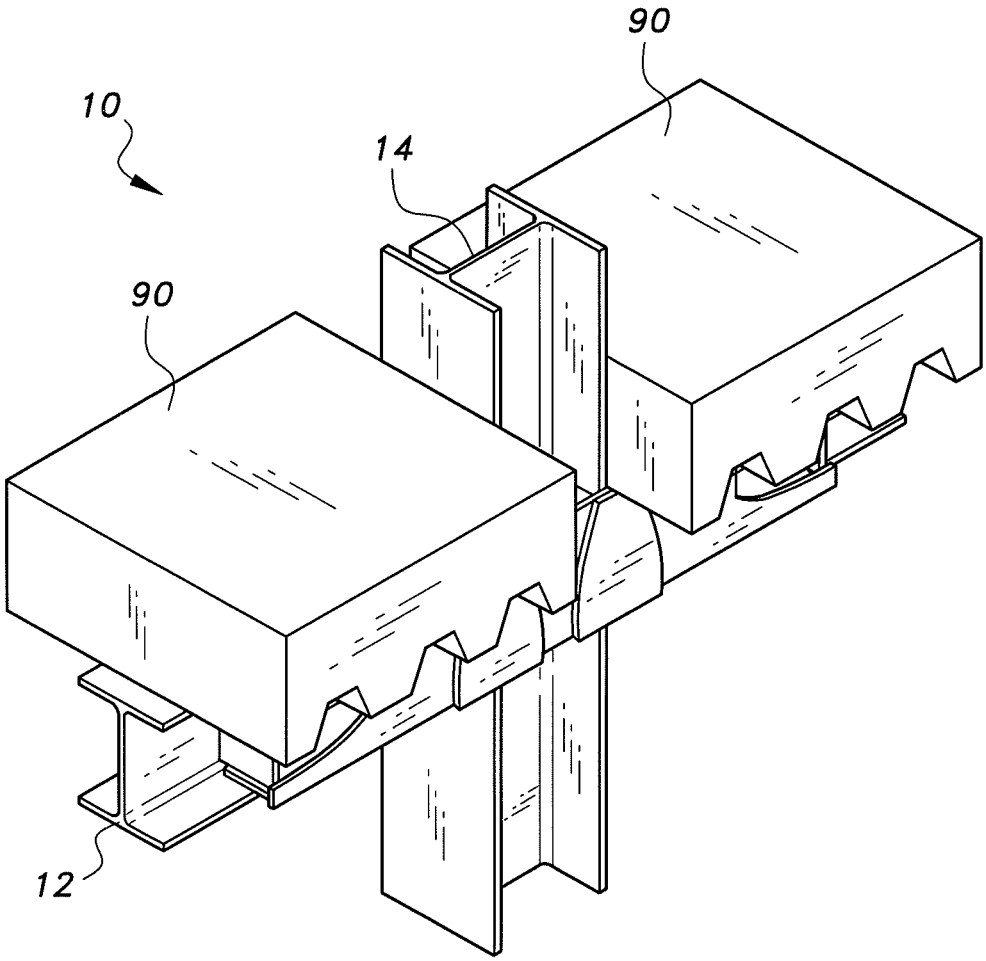
FIG. 7 is an environmental partial perspective view of the reinforced joint of FIG. 1, shown with the beams supporting slabs of reinforced concrete.

In reference to FIGS. 1-3, the reinforced joint 10 is shown and described with respect to only the front side of the joint 32 between the first and second structural beams 28, 30 and structural column 14 (i.e., the side facing the viewer in the orientation of FIGS. 1-3). It should be understood that this is for purposes of illustration and simplifying the drawings only, and that an identical structure is also mounted on the rear side of the joint 32. Further, it should be understood that for purposes of illustration and clarity, FIG. 3 does not include cover stiffening plate 54 (shown in FIGS. 1 and 2). FIG. 7 illustrates the reinforced joint for a beam-column connection 10 in use, with the set of structural beams 12 being shown supporting slabs of reinforced concrete 90. It should be understood that the slabs of reinforced concrete 90 are shown for exemplary purposes only.

As shown in FIGS. 2 and 3, the first upper and lower flange stiffening plates 18, 20 are positioned adjacent the structural column 14 on the first structural beam 28, and the second upper and lower flange stiffening plates 22, 24 are positioned adjacent the structural column 14 on the second structural beam 30. As best seen in FIGS. 2 and 3, each set of upper and lower flange stiffening plates may be placed adjacent and contiguous to a corresponding shear plate 16. The shear plates 16 are typically bolted to the beams 28, 30 on either side of the structural column 14 in a conventional, non-reinforced beam-column joint. Each of the flange stiffening plates 18, 20, 22, 24 is attached by welding or the like to one of the corresponding flanges 50, 52 of structural column 14.

As discussed above, although the reinforced joint 10 is only described above with reference to the structure on one side of joint 32, this is solely for purposes of simplification and illustration and, in practice, an identical structure is formed on the rear side of joint 32. Thus, as an alternative, the upper flange stiffening plates 18, 22 may each be replaced by wider plates mounted on the exterior faces of flanges 26, 34, extending across the entire width of each flange. Similarly, the lower flange stiffening plates 20, 24 may each be replaced by wider plates mounted on the exterior faces of flanges 29, 36, extending across the entire width of each flange. The width of each of these alternative plates would match the width of the flanges 50, 52 of structural column 14. As a further alternative, both interior and exterior flange stiffening plates may be used in combination.

At least one first beam web stiffener is secured to, and extends between, the first upper and lower flange stiffening plates 18, 20, and at least one second beam web stiffener is secured to, and extends between, the second upper and lower flange stiffening plates 22, 24. In FIGS. 2 and 3, two such first beam web stiffeners 38, 40 and two such second beam web stiffeners 42, 44 are shown, although it should be understood that any suitable number of beam web stiffeners may be used. Web stiffeners 38, 40, 42, 44 may be welded to their respective flange stiffening plates. As shown, each of first beam web stiffeners 38, 40 preferably extends orthogonally with respect to the first upper and lower flange stiffening plates 18, 20. Similarly, each of second beam web stiffener 42, 44 preferably extends orthogonally with respect to the first upper and lower flange stiffening plates 22, 24. Each of the web stiffeners 38, 40, 42, 44 may have a length of $D_b-2t_{f,b}-2t$, a width of $(B_{f,c}-t_{w,b})/2$ and a thickness of t, where $D_b$ is the depth of each beam of the set of structural beams 12, $B_{f,c}$ is the width of the flanges of structural column 14, and $t_{w,b}$ is the thickness of the web of each beam of the set of structural beams 12. $D_b$ is taken as the depth measured between the outer faces of the beam flanges. Further, each of the web stiffeners 38, 40, 42, 44 may be formed from steel or the like.

Upper and lower column web stiffeners 46, 48, respectively are also attached to and extend between first and second flanges 50, 52, respectively, of the structural column 14. The upper and lower column web stiffeners 46, 48 may be welded to first and second flanges 50, 52. The upper and lower column web stiffeners 46, 48 are respectively aligned with and coplanar to the first and second upper flange stiffening plates 18, 22 and with and coplanar to the first and second lower flange stiffening plates 20, 24. Each of the column web stiffeners 46, 48 may have a length of $D_c-2t_{f,c}$, a width of $(B_{f,c}-t_{w,b})/2$ and a thickness of t, where $D_c$ is the depth of structural column 14, $B_{f,c}$ is the width of the flanges of structural column 14, and t is the thickness of the web stiffeners 38, 40, 42, 44. Further, each of the column web stiffeners 46, 48 may be formed from steel or the like.

A longitudinal cover stiffening plate 54 is attached to the upper and lower column stiffeners 46, 48, the first and second upper flange stiffening plates 18, 22, and the first and second lower flange stiffening plates 20, 24 by welding or the like. The cover stiffening plate 54 extends between the at least one first beam web stiffener and the at least one second beam web stiffener. In the exemplary embodiment of FIGS. 1-3, in which two beam web stiffeners 38, 40 are mounted on the first structural beam 28, and two beam web stiffeners 42, 44 are mounted on the second structural beam 30, the cover stiffening plate 54 extends between the two outermost beam web stiffeners 38, 44. The cover stiffening plate 54 may have a length of $2(kD_b+g)+D_c$, a width of $D_b$, and a thickness oft, where k=2 to 2.5, $D_b$ is the depth of each beam of the set of structural beams 12, $D_c$ is the depth of structural column 14, and t is the thickness of the web stiffeners 38, 40, 42, 44 and the column web stiffeners 46, 48. The cover stiffening plate 54 may be formed from steel or the like. Thus, for an interior joint, the cover stiffening plate 54 extends across the column 14 of the beam-column joint 32, and is indirectly attached to the beams 28, 30 on opposite sides of the joint by welding to the corresponding stiffeners.

As shown in FIGS. 1 and 2, the cover stiffening plate 54 may have truncated semi-elliptical recesses 60, 62 formed in opposed first and second ends 56, 58 thereof. The recesses 60, 62 expose the two outermost beam web stiffeners 38, 44, and the two innermost beam web stiffeners 40, 42 being covered. The recesses 60, 62 are provided to avoid sudden changes in the moment of inertia of the set of structural beams 12. Additionally, first and second recesses 60, 62 are helpful for welding the flange stiffening plates and the beam web stiffeners with the cover stiffening plate in the accessible zone during installation.

Further, as shown, at least one exterior stiffening plate may be secured to an exterior face 61 of the cover stiffening plate 54 opposite the column flanges by welding or the like. In FIGS. 1 and 2, two such exterior stiffening plates 63, 64 are shown. However, it should be understood that any suitable number of exterior stiffening plates may be used. Each exterior stiffening plate 63, 64 may have a semi-elliptical contour. The exterior stiffening plates 63, 64 may be the material removed from the cover stiffening plate 54 during the formation of recesses 60, 62, thus recycling waste material into material useful for providing additional strengthening to the connection joint. Each of the exterior stiffening plates may have a length of $D_b$, a minor elliptical diameter of $0.8D_b$ to $0.9D_b$, and a thickness equal to that of the web stiffeners 38, 40, 42, 44 and the column web stiffeners 46, 48, where $D_b$ is the depth of each beam of the set of structural beams 12. The width of each exterior stiffening plate at the top may be between 5 cm and 15 cm.

Figure 11:
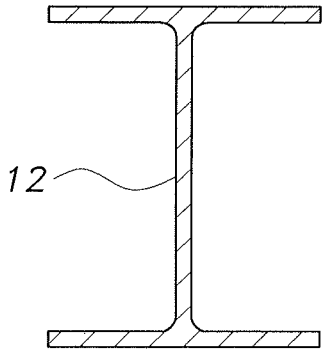
FIG. 11 is a section view along lines 11-11 of FIG. 10.
Figure 12:
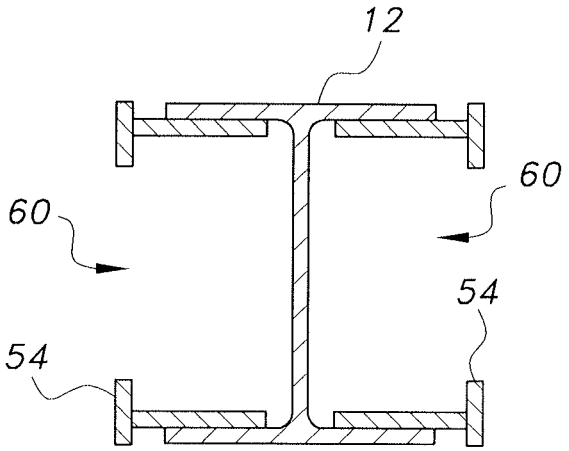
FIG. 12 is a section view along lines 12-12 of FIG. 10.
Figure 13:
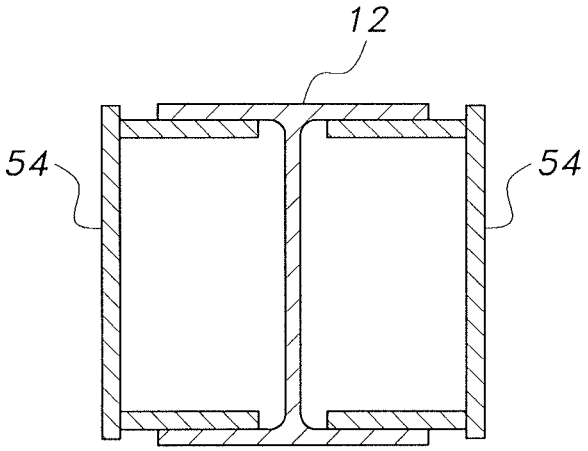
FIG. 13 is a section view along lines 13-13 of FIG. 10.
Figure 14:
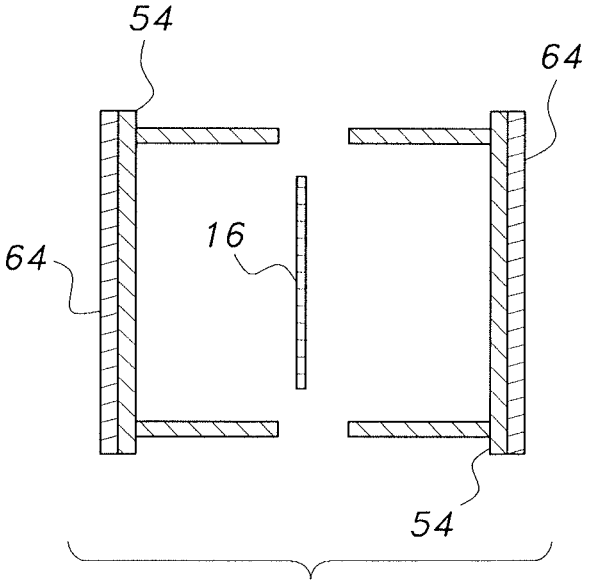
FIG. 14 is a section view along lines 14-14 of FIG. 10.

With reference to FIGS. 10-14, FIG. 11 shows the I-beam cross section of the beams 28, 30 of the set of structural beams 12. As discussed above, the reinforced joint 32 is shown in FIG. 10, and described above, with respect to only one side of the joint 32 between the set of structural beams 12 and structural column 14 (i.e., the front side facing the viewer in the orientation of FIG. 10). It should be understood that this is for purposes of illustration and simplifying the drawings only, and that an identical structure is also mounted on the rear side of the joint 32. Thus, FIGS. 11-14 also show portions of this identical structure. FIG. 12 is a section view taken within the region of the recess 60 of the cover stiffening plate 54. FIG. 13 is a section view taken within the solid portion of the cover stiffening plate 54. FIG. 14 is a section view taken within the gap between the end of the second structural beam 30 and the face of the structural column 14, showing one of the flange stiffening plates 16, also shown in FIG. 2.

Table 1, below, shows the enhancement of the moment of inertia and shear area in each of these regions, before reinforcement (i.e., without the reinforced joint 10) and with reinforcement (i.e., with the reinforced joint 10). In Table 1, $I_b$ is the moment of inertia of each beam of the set 12 of structural beams, $A_w$ is the shear area of each beam of the set 12 of structural beams, and $\alpha$ and $\beta$ are the moment and shear enhancement factors, respectively. As can be seen in Table 1, the shear capacity is more than doubled in the connection zone. The increase in moment of inertia causes a proportionate increase in the elastic moment of resistance. However, the enhancement in the ultimate moment of resistance will be much higher due to the presence of strain hardening in the stress-strain behavior of steel beams. The enhancement in the moment and shear capacity of the joint not only helps to increase the load-resisting capacity of the frame, but also helps in the development of the catenary mechanism in the event of column loss, thereby enhancing the progressive collapse resistance of the frame.

TABLE 1

Enhancement in Moment of Inertia and Shear Area in the Connection Zone

| | Moment of Inertia = $\alpha I_b$ | | Shear Area = $\beta A_w$ | |
|---|---|---|---|---|
| Region of Connection Zone | Before reinforcement | After reinforcement | Before reinforcement | After reinforcement |
| Section 11-11, FIG. 11 | $\alpha = 1$ | $\alpha = 1$ | $\beta = 1$ | $\beta = 1$ |
| Section 12-12, FIG. 12 | $\alpha = 1$ | $\alpha > 2$ | $\beta = 1$ | $\beta > 1$ to $\beta > 3$ |
| Section 13-13, FIG. 13 | $\alpha = 1$ | $\alpha > 2$ | $\beta = 1$ | $\beta > 3$ |
| Section 14-14, FIG. 14 | $\alpha = 0$ | $\alpha > 1$ | $\beta \approx 1$ | $\beta > 2$ |

Figure 4:
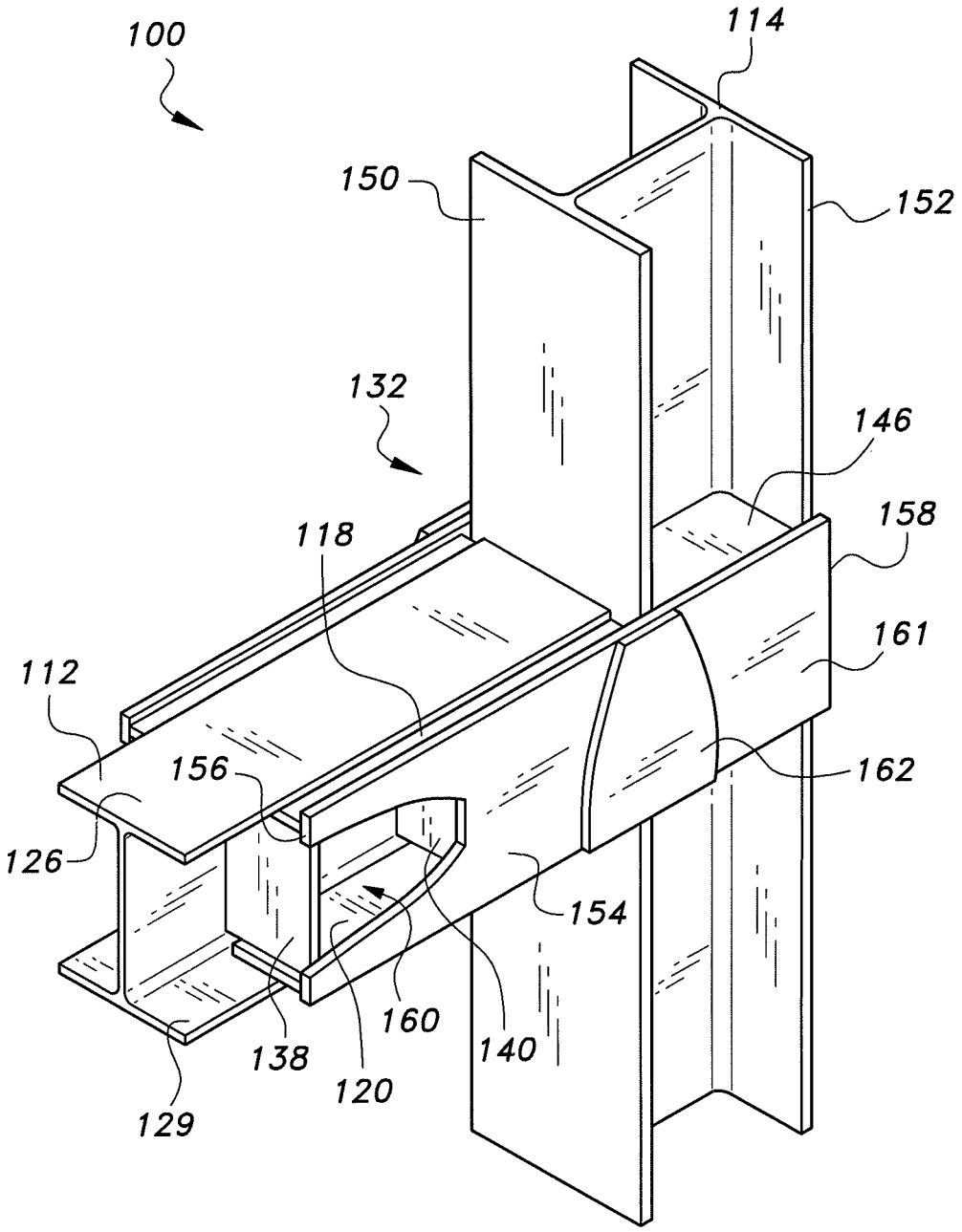
FIG. 4 is a partial perspective view of a reinforced joint for beam-column connection for an exterior beam-column joint in a steel frame building.
Figure 5:
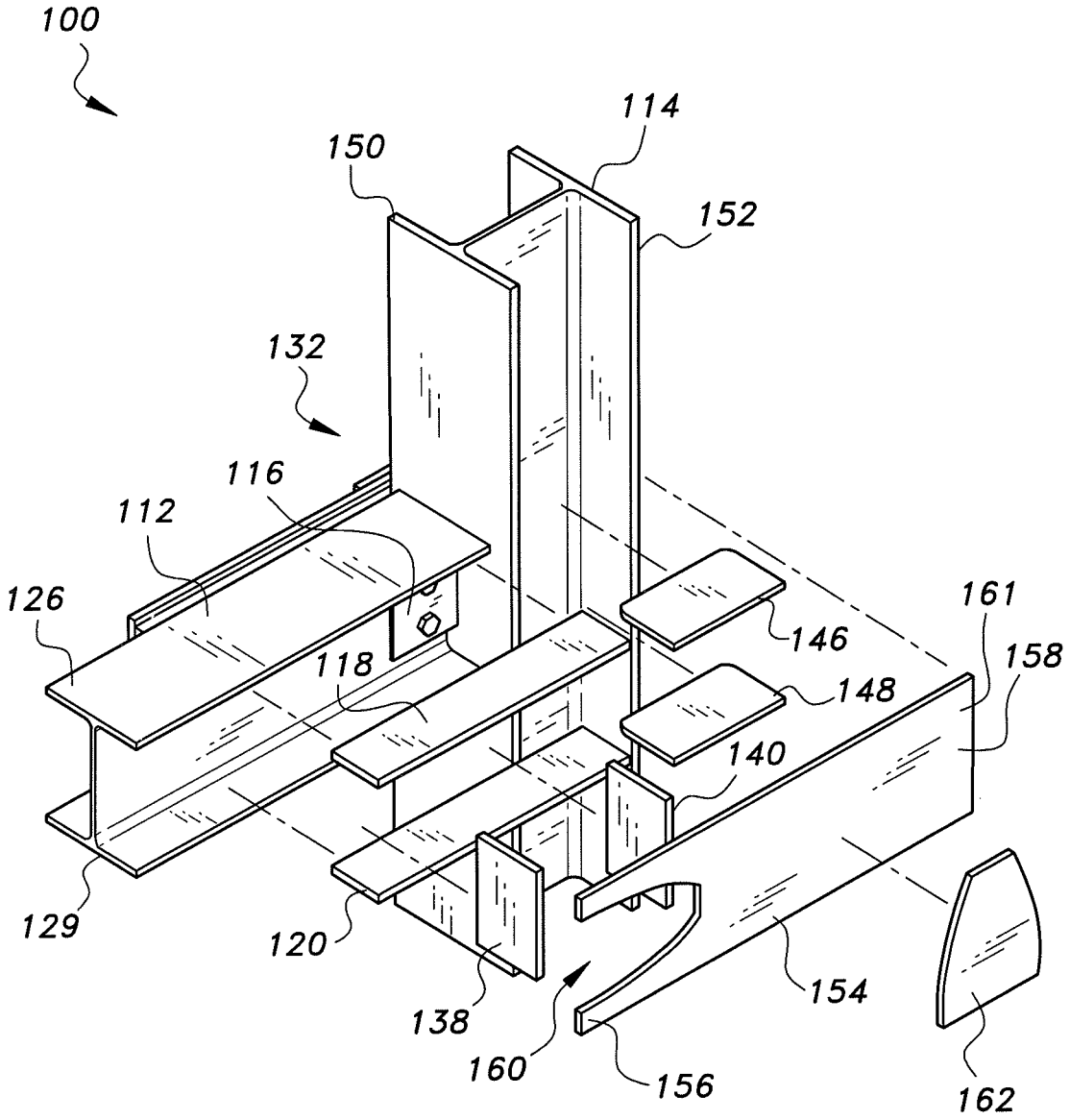
FIG. 5 is a partially exploded perspective view of the reinforced joint of FIG. 4.
Figure 6:
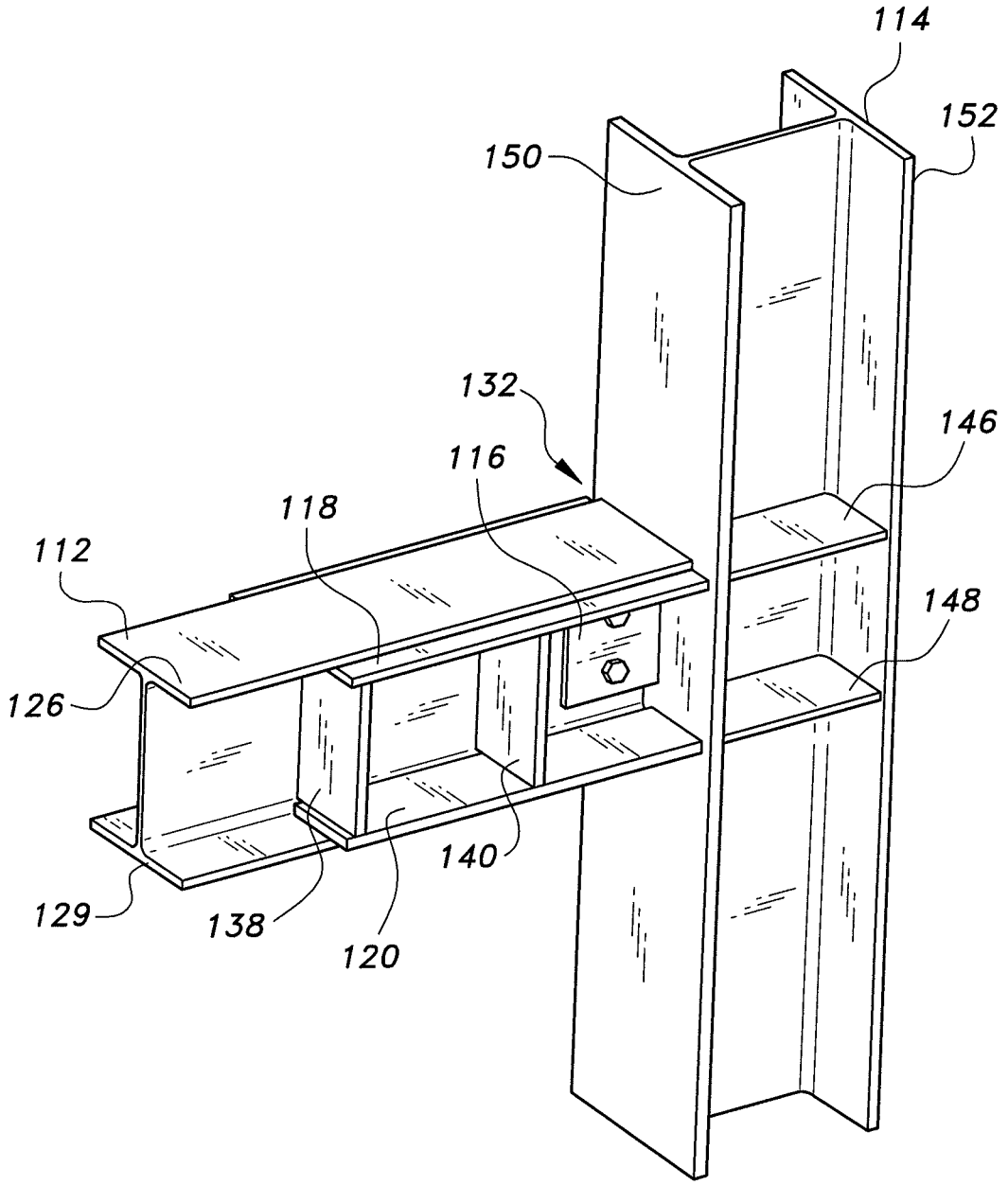
FIG. 6 is a partial perspective view of the reinforced joint of FIG. 4, shown without the longitudinal cover plate.

FIGS. 4-6 show a reinforced joint for a beam-column connection 100 that is used as an external joint in the building frame. The upper and lower flange stiffening plates 118, 120 are attached to inner faces of the upper and lower flanges 126, 129, respectively, of structural beam 112, e.g., by welding. The upper and lower flange stiffening plates 118, 120 are positioned adjacent a connection joint 132 between the structural beam 112 and a structural column 114. In reference to FIGS. 4-6, the reinforced joint 100 is shown and described with respect to only the front side of the joint 132 between the structural beam 112 and the structural column 114 (i.e., the side facing the viewer in the orientation of FIGS. 4-6). It should be understood that this is for purposes of illustration and simplifying the drawings only, and that an identical structure is also mounted on the rear side of the joint 132. Further, it should be understood that for purposes of illustration and clarity, FIG. 6 does not include the longitudinal cover stiffening plate 154 (shown in FIGS. 4 and 5). Each of the flange stiffening plates 118, 120 may have a length of $k\,D_b+g$, a width of $(B_{f,c}-t_{w,b})/2$ and a thickness greater than or equal to $t_{f,b}$, where k=2 to 2.5, $D_b$ is the depth of structural beam 112, g is the gap between the end of structural beam 112 and the face of structural column 114, $B_{f,c}$ is the width of the flanges of structural column 114, and $t_{w,b}$ is the thickness of the web of structural beam 112. Each of the flange stiffening plates 118, 120 may have chamfered or filleted corners. Further, each of the flange stiffening plates 118, 120 may be formed from steel or the like.

As shown in FIGS. 4 and 6, the upper and lower flange stiffening plates 118, 120 may have respective widths greater than widths of the upper and lower flanges 126, 129 of the structural beam 12. Thus, the upper and lower flange stiffening plates 118, 120 extend beyond the upper and lower flanges 126, 129 of the structural beam 112. At least one beam web stiffener is attached to and extends between the upper and lower flange stiffening plates 118, 120. FIGS. 5 and 6 show a pair of such beam web stiffeners 138, 140, although it should be understood that any suitable number of beam web stiffeners may be used. As shown, the beam web stiffeners 138, 140 preferably extend orthogonally with respect to the upper and lower flange stiffening plates 118, 120. Each of the web stiffeners 138, 140 may have a length of $D_b-2_{f,b}-2t$, a width of $(B_{f,c}-t_{w,b})/2$ and a thickness of t, where $D_b$ is the depth of structural beam 112, $B_{f,c}$ is the width of the flanges of structural column 114, $t_{f,b}$ is the thickness of the flange of structural beam 112, and $t_{w,b}$ is the thickness of the web of structural beam 112. Further, each of the web stiffeners 138, 140 may be formed from steel or the like.

Additionally, upper and lower column web stiffeners 146, 148 are attached to and extend between the first and second flanges 150, 152 of the structural column 114. The upper and lower column web stiffeners 146, 148 are aligned with and coplanar to the upper and lower flange stiffening plates 118, 120, respectively. Each of the column web stiffeners 146, 148 may have a length of $D_c-2t_{f,c}$, a width of $(B_{f,c}-t_{w,b})/2$ and a thickness of t, where $D_c$ is the depth of structural column 114, $B_{f,c}$ is the width of the flanges of structural column 114, $t_{f,c}$ is the thickness of the flange of structural column 114, $t_{w,b}$ is the thickness of the web of structural beam 112 and t is the thickness of the web stiffeners 138, 140. Further, each of the column web stiffeners 146, 148 may be formed from steel or the like.

A longitudinal cover stiffening plate 154 is attached to the upper and lower column stiffeners 146, 148 and the upper and lower flange stiffening plates 118, 120. The cover stiffening plate 154 extends between the at least one beam web stiffener and the second flange 152 of the structural column 114. In the exemplary embodiment of FIGS. 4-6, the cover stiffening plate 154 extends between the outermost beam web stiffener 138 and second flange 152, i.e., the longitudinal cover stiffening plate 154 extends across the beam-column joint 132.

As shown in FIGS. 4 and 5, the longitudinal cover stiffening plate 154 may have a truncated semi-elliptical recess 160 formed in a first end 156 thereof. The first end 156 is positioned opposite a second end 158, which is mounted adjacent the second flange 152 of the structural column 114. The recess 160 may expose the outermost beam web stiffener 138, and the innermost beam web stiffener 140 being covered. Further, at least one exterior stiffening plate 162 may be attached to an exterior face 161 of the cover stiffening plate 154. The exterior stiffening plate 162 may be a semi-elliptical, and may be formed from the material removed to defing the recess 160. Unlike the previous embodiment, the cover stiffening plate 154 may have a length of $(k\ D_b+g)+D_c$, a width of $D_b$, and a thickness of t, where k=2 to 2.5, $D_b$ is the depth of structural beam 112, g is the gap between the end of structural beam 112 and the face of structural column 114, $D_c$ is the depth of structural column 14, and t is the thickness of the web stiffeners 138, 140 and the column web stiffeners 146, 148.

Figure 8:
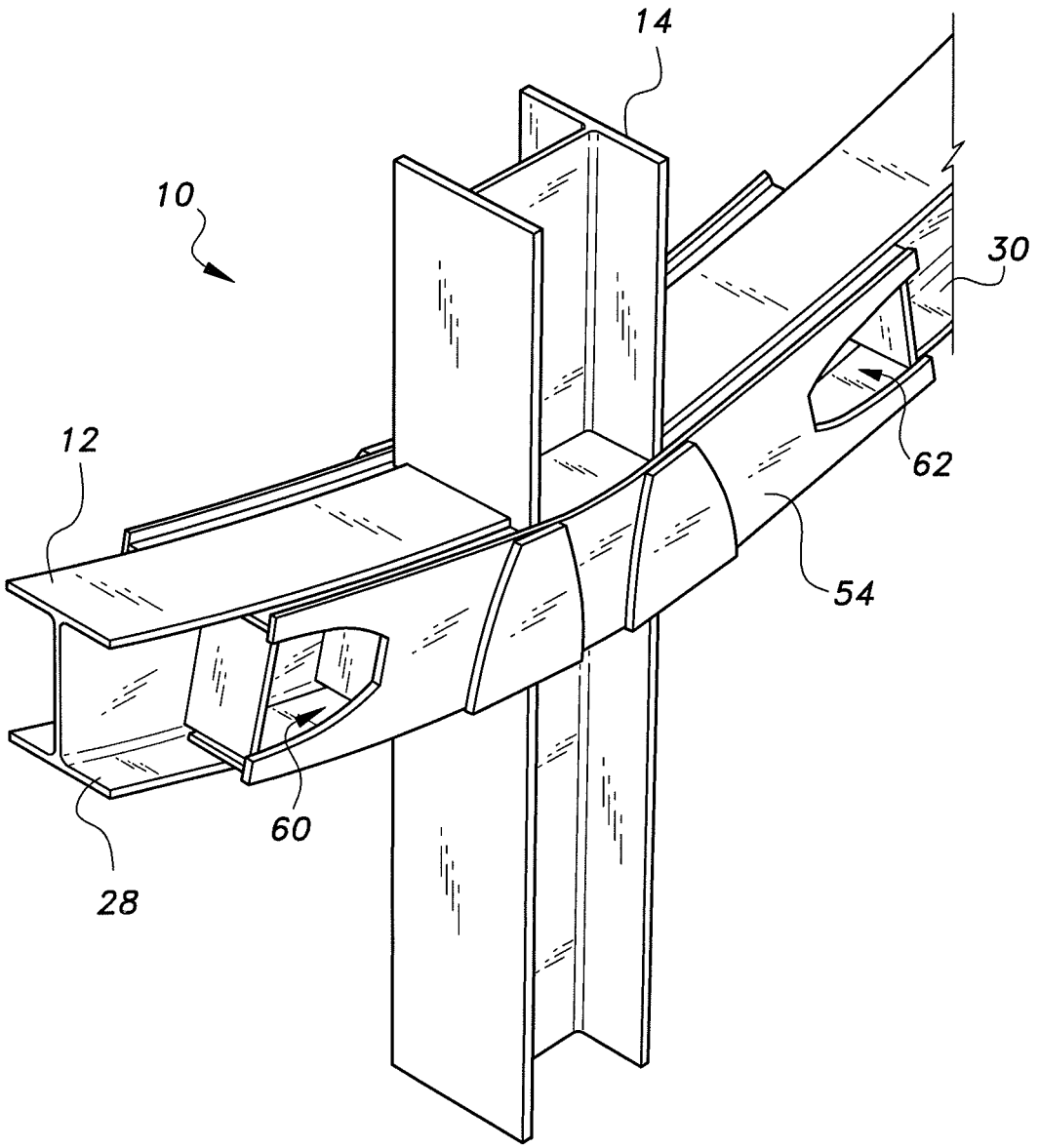
FIG. 8 is a partial perspective view of the reinforced joint of FIG. 1, shown in use during progressive collapse.
Figure 9:
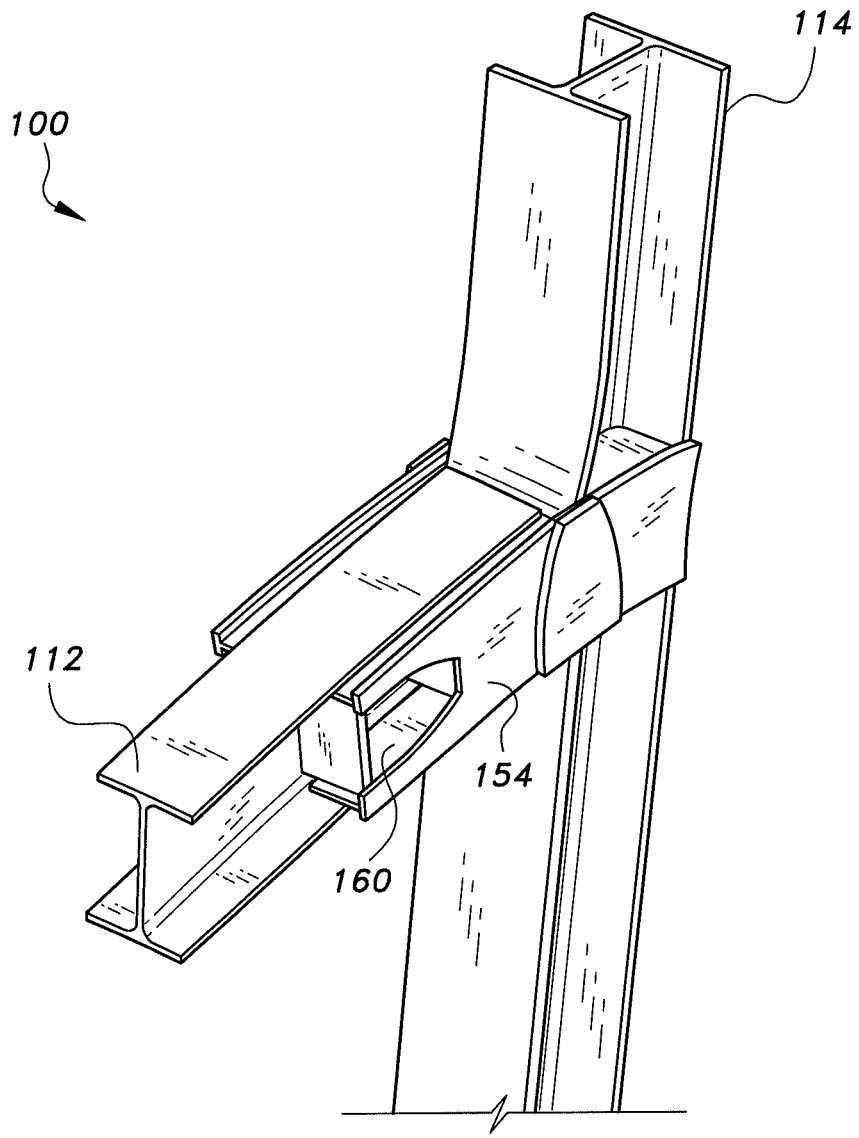
FIG. 9 is a partial perspective view of the reinforced joint of FIG. 4, shown in use during progressive collapse.
Figure 10:
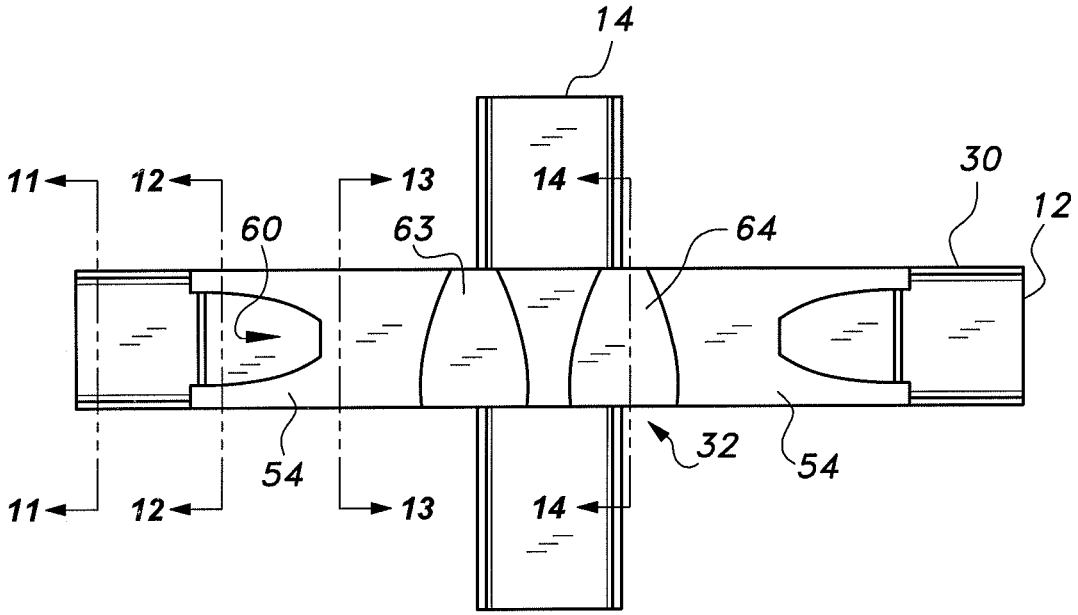
FIG. 10 is a front view of the reinforced joint of FIG. 1.

FIGS. 8 and 9 show the reinforced joints 10, 100, respectively, in use during progressive collapse. As shown, the reinforced joints 10, 100 provide alternative load transfer paths during progressive collapse, and further aid in the development of catenary action in the beams 12, 112, respectively, connected to the joint of the damaged column 14, 114, respectively. As shown in FIG. 8, the catenary action develops due to the connection of the two sides 28, 30 of structural beam 12 through the longitudinal cover stiffening plate 54. The longitudinal cover stiffening plate 154 in FIG. 9 performs a similar function with regard to structural beam 112. These cover stiffening plates 54, 154 also enhance the shear capacity of the beams 12, 112, respectively. The beam flange stiffening plates 18, 20, 22, 24 of reinforced joint 10 and the beam flange stiffening plates 118, 120 of reinforced joint 100 help in improving the moment of resistance, whereas the beam web and column web stiffeners 38, 40, 42, 44, 46, 48 of reinforced joint 10 and 138, 140, 146, 148 of reinforced joint 100 help in resisting the buckling of the respective beam and column webs. The recesses 60, 62 in cover stiffening plate 54 and recess 160 in cover stiffening plate 154 not only help in welding the otherwise inaccessible areas of reinforced joints 10, 100, but also provide a smooth transition in the enhancement of the moment resisting capacity in the connection region.

It is to be understood that the beam-column connections for steel framed buildings is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A reinforced joint for a beam-column connection of a steel frame structure, comprising:

a steel column having a pair of spaced flange plates and a web plate joining the spaced flange plates, the column having an I-shape in section, the web plate having a front face and a rear face defining a front and a rear of the joint, the column extending vertically;

a first beam and a second beam connected to and extending normal from the column, the second beam extending from the column opposite the first beam, the beam-column connection being an interior beam-column joint in a steel frame structure, each of the beams having a pair of spaced flange plates and a web plate joining the spaced flange plates, each of the beams having an I-shape in section, wherein each of the spaced flange plates have inner faces and outer faces, the web plate having a front face and a rear face, the column and the first and second beams defining a beam-column connection;

on both the front and the rear of the joint, an upper flange stiffening plate and a lower flange stiffening plate attached directly to the inner faces of each of the flange plates of each of the beams, respectively, adjacent to the web plate of the beams and adjacent to the beam-column connection so that the upper and lower flange stiffening plates face each other;

at least one web stiffening plate attached to and extending between the upper and lower flange stiffening plates and extending normal to the web plate of each of the beams;

an upper web stiffening plate and a lower web stiffening plate attached to and extending between the flanges of the column, the upper web stiffening plate being coplanar with the upper flange stiffening plate of each beam and the lower web stiffening plate being coplanar with the lower flange stiffening plate of each beam; and a longitudinal cover stiffening plate extending across the flanges of the column and attached to and covering edges of the web stiffening plates of the column and edges of the flange stiffening plates of the first and second beams.

2. The reinforced joint according to claim 1, wherein said at least one web stiffening plate of each said beam comprises a first web stiffening plate disposed adjacent said column and a second, outermost web stiffening plate, said longitudinal cover stiffening plate having a length extending at least as far as the outermost web stiffening plate of each of said beams.

3. The reinforced joint according to claim 1, wherein said longitudinal cover stiffening plate extends across the flanges of the column and is attached to and covers edges of the web stiffening plates of the column and edges of the flange stiffening plates of both the first beam and the second beam.

4. The reinforced joint according to claim 1, wherein said longitudinal cover stiffening plate has opposing ends, each of the ends having a semi-elliptical recess defined therein.

5. The reinforced joint according to claim 1, wherein said longitudinal cover stiffening plate has an external surface, the reinforced joint further comprising first and second external stiffening plates attached to the external surface of said longitudinal cover stiffening plate opposite the flanges of said column, respectively.

* * * * *